US011149728B2

(12) United States Patent
Hurst et al.

(10) Patent No.: US 11,149,728 B2
(45) Date of Patent: Oct. 19, 2021

(54) PUMP PLUNGER PROTECTIVE PACKAGING

(71) Applicant: HALLIBURTON ENERGY SERVICES, INC., Houston, TX (US)

(72) Inventors: Justin Lee Hurst, Healdton, OK (US); David Mark Stribling, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 219 days.

(21) Appl. No.: 16/538,248

(22) Filed: Aug. 12, 2019

(65) Prior Publication Data

US 2021/0048021 A1 Feb. 18, 2021

(51) Int. Cl.

| | |
|---|---|
| ***F04B 53/22*** | (2006.01) |
| ***F04B 15/02*** | (2006.01) |
| ***B65D 83/00*** | (2006.01) |
| *E21B 43/26* | (2006.01) |

(52) U.S. Cl.

CPC ..... *F04B 53/22* (2013.01); *B65D 83/0005* (2013.01); *E21B 43/26* (2013.01); *F04B 15/02* (2013.01)

(58) Field of Classification Search

CPC ..... F04B 53/22; F04B 53/166; F04B 15/02; B23P 19/12; B23P 19/043; B65D 83/02; B65D 83/0005; B65D 83/0022; B65D 83/005; B65D 85/20; B65D 85/24; Y10T 29/49229; Y10T 29/49236

USPC ..... 53/254; 222/386

See application file for complete search history.

(56) References Cited

U.S. PATENT DOCUMENTS

| | | | | |
|---|---|---|---|---|
| 1,933,596 | A * | 11/1933 | Showles | A23G 9/503 426/115 |
| 2003/0084556 | A1 * | 5/2003 | Dunlop | B25B 27/023 29/259 |
| 2011/0030213 | A1 | 2/2011 | Hawes et al. | |
| 2011/0162187 | A1 * | 7/2011 | Patel | F04B 23/00 29/428 |

* cited by examiner

*Primary Examiner* — Kenneth J Hansen

(57) ABSTRACT

A system for installing replacement plungers in plunger pumps used in the hydrocarbon industry includes an elongated, cylindrical plunger body with an elongated circular tube disposed around the cylindrical plunger body. An end wall having an aperture encloses one end of the tube with an axially movable plate adjacent the end wall between the end wall and an end of the plunger body. A removable cap is mounted to the opposite end of the tube to enclose the plunger body within the tube. The outer diameter of the tube fits in the plunger bore of a pump. To install the replacement plunger, the cap is removed and the tube is inserted into the plunger bore until the tube abuts packing within the tube. Once positioned, an axial force is applied to the movable plate to urge the plunger body from the tube and into engagement with the packing.

20 Claims, 3 Drawing Sheets

PUMP PLUNGER PROTECTIVE PACKAGING

TECHNICAL FIELD

The invention relates to maintenance hydraulic fracturing pumps, and, in particular, to a replacement pump plunger for insertion into a plunger pump.

BACKGROUND OF THE INVENTION

Plunger pumps are used in the oil and gas industry for, among other things, pumping hydraulic fracturing slurries to a wellbore. Plunger pumps operate by rapidly reciprocating one or more plunger(s) in a pump cylinder formed in the fluid end of a plunger pump. As the plunger(s) reciprocates through a retraction stroke, pressure is released on an inlet check valve and fluid is drawn into a pump chamber from a fluid source. As the plunger(s) reciprocates through an extension stroke, the plunger applies pressure to the fluid. The pressurized fluid urges the inlet check valve to close and at the same time urges an outlet check valve to open, allowing fluid within the pump chamber to pass through the outlet check valve. The pump plunger(s) is surrounded by a packing that provides a fluid seal around the plunger. Because of the high pressures and long run times associated with plunger pumps utilized in the oil and gas industry, many of the moving components of the plunger pump must be replaced frequently, including the plunger itself, the packing, valves and valve seats. Because the fit between the packing and the plunger must be fluid tight, inserting a plunger through packing can be difficult, particularly if the packing is new. The plunger needs to align with an aperture in a center of the packing for proper insertion. If the plunger is not well aligned with the aperture in the packing, insertion of the plunger can damage the packing and shorten its service life. In this same vein, if the plunger is damaged during transport or insertion, damage to the plunger can result in shortened service life of the packing.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE PREFERRED EMBODIMENT

Generally, a plunger assembly for a plunger pump is provided, wherein the assembly includes a plunger housed in a plunger tube for transport and installation of the plunger into a plunger pump.

The plunger tube includes a removable cap at one end and an opposing slidable plate at an opposite end. With the removable cap of the plunger tube detached, the tube can be engaged with the fluid end of a plunger pump so that the tube, and therefore the plunger within the tube, is axially aligned with a pump cylinder and the packing within the pump cylinder. Application of an axial insertion force to the slidable plate of the plunger tube urges the plunger into the fluid end, and in particular, into the pump cylinder for engagement with the pump packing.

Figure 1:
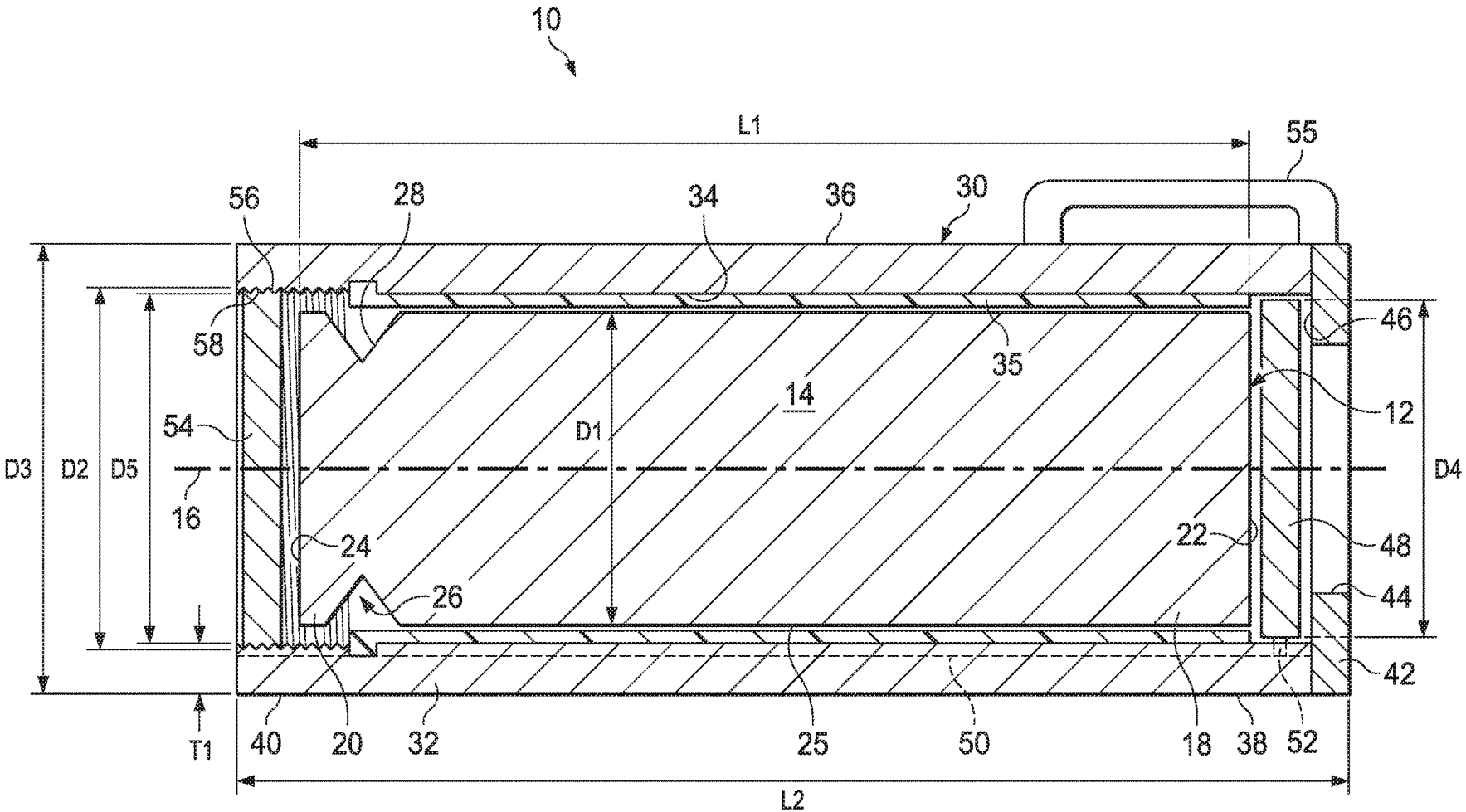
FIG. 1 is a cut-away elevation view of a plunger assembly for use with a plunger pump.

With reference to FIG. 1, a plunger assembly 10 is illustrated. The plunger assembly 10 generally includes a plunger 12 formed of an elongated, cylindrical body 14 disposed along a plunger axis 16, the plunger 12 having a first end 18 and a second end 20. First end 18 includes a first end surface 22 that is generally perpendicular to plunger axis 16. Likewise, second end 20 includes a second end surface 24 that is generally perpendicular to plunger axis 16. Cylindrical body 14 has a length L1 between the first end 18 and the second end 20. Cylindrical body 14 includes an outer cylinder surface 25 and has a plunger outer diameter D1. In some embodiments, at least one of the ends 18, 20 may include an attachment mechanism 26 for securing the plunger 12 to a reciprocal arm (not shown) of a plunger pump (not shown). In the illustrated embodiment, the attachment mechanism 26 may be a contour or profile 28 such as is shown in FIG. 1 in the outer cylinder surface 25. Cylindrical body 14 may be solid or hollow and the disclosure is not limited in this regard. Moreover, the material of manufacture of cylinder body is not intended as limiting.

In one or more embodiments, cylinder body is fabricated of carbon steel.

The plunger assembly 10 further includes an elongated tube 30 disposed around cylindrical body 14 and generally coaxial with plunger axis 16. As used herein, elongated generally refers to a body with an axial length greater than a radial width. As will be described in more detail below, elongated tube 30 is shaped to engage the bore of a plunger pump. As such, elongated tube 30 is generally cylindrical in cross-sectional shape, although in some embodiments, elongated tube 30 may be polygonal in cross-sectional shape. In any event, elongated tube 30 if formed of a tube wall 32 having a wall thickness T1 between an inner tube surface 34 and an outer tube surface 36.

In one or more embodiments, at least a portion of inner tube surface 34 may include a protective liner 35 to further prevent damage to plunger 12 and/or to aid in insertion and removal of plunger 12 from elongated tube 30. In one or more embodiment, liner 35 may be polytetrafluoroethene or other plastic. In one or more embodiment, liner 35 may be rubber or other elastomer. In one or more embodiments, wall 32 of tube 30 may be formed of metal and liner 35 may be polytetrafluoroethene or other plastic. In one or more embodiments, wall 32 of tube 30 may be formed of polytetrafluoroethene obviating the need for a liner 35. Elongated tube 30 has an inner tube diameter D2 which is no less than the outer plunger diameter D1. Elongated tube 30 also has an outer tube diameter D3. Elongated tube 30 has a first end 38 and a second end 40 with a tube length L2 between the first and second ends 38, 40. In one or more embodiments, tube length L2 is great than cylinder body length L1.

First end 38 of tube 30 includes an end wall 42 that is generally perpendicular to axis 16. End wall 42 includes an aperture 44 formed therein and partially encloses first end 38 of tube 30. While aperture 44 need not be limited to a particular shape or orientation, in one or more embodiments, aperture 44 is coaxial with axis 16 and in one or more embodiments, aperture 44 is circular in shape. In any event, end wall 42 includes an inner surface 46.

Plunger assembly 10 further includes a movable plate 48 disposed within cylindrical body 14 and generally adjacent inner surface 46 of end wall 42, thereby overlaying aperture 44. In one or more embodiments, movable plate 48 abuts inner surface 46 of end wall 42. In one or more embodiments, movable plate 48 at least partially covers first end surface 22 of cylindrical body 14, while in other embodiments, movable plate 48 fully covers first end surface 22 of cylindrical body 14. In one or more embodiments, movable plate 48 is circular in shape, axially aligned with axis 16 and has a diameter D4. In some embodiments, plate diameter D4 is less than inner tube diameter D2. In some embodiments, plate diameter D4 is substantially the same as cylinder diameter D1.

In one or more embodiments, inner tube surface 34 of elongated tube 30 may include an axially extending slot or track 50 formed therein along at least a portion of inner tube surface 34. Slot 50 is disposed to receive a guide mechanism 52 which may extend radially from movable plate 48.

In one or more embodiments, elongated tube 30 may include at least two spaced apart slots 50 and movable plate 48 may include two spaced apart guide mechanisms 52, each disposed to engage a slot 50. In one or more embodiments, slot(s) 50 are linear and parallel with axis 16. In some embodiments, two slots 50 may be provided and spaced apart from one another approximately 180 degrees from one another within tube 30. It will be appreciated that in these embodiments, as movable plate 48 is axially translated along tube 30, slot(s) 50 and guide mechanism(s) 52 will function to prevent rotation of movable plate 48. In other embodiments, two or more spaced apart slots 50 may spiral along the length of tube 30. In some embodiments, two spiraling slots 50 may be provided and spaced apart from one another approximately 180 degrees from one another within tube 30 as the slots spiral about axis 16 along at least a portion of the length of tube 30. It will be appreciated that in the case of spiraling slots 50, movable plate 48 will rotate as it translates along axis 16 from first end 38 of tube 30 towards second end 40 of tube 30.

Plunger assembly 10 further includes a cap 54 disposed at the second end 40 of elongated tube 30.

In one or more embodiments, cap 54 has a diameter D5 selected to allow cap 54 to mount within the second end 40 of tube 30 so as to be adjacent the second end surface 24 of plunger 12. In one or more embodiments, inner tube surface 34 adjacent second end 40 of tube 30 may include threads 56 to receive corresponding threads 58 provided around the periphery of cap 54. Threads 56 may extend axially from second end 40 a sufficient distance towards first end 38 past second end 20 of plunger 12, permitting cap 54 to tighten against plunger 12 and forcing plunger 12 to abut movable plate 48. In one or more embodiments, the liner 35 terminates along the inner tube surface 34 adjacent the threads 56 so as not to cover the threads, but to allow cylindrical body 14 to be engaged by cap 54.

In other embodiments, cap 54 may engage second end 40 of tube 30 in another manner. For example, cap 54 may fit over the second end 40 of tube 30. In such an embodiment, cap 54 may include a lip or other structure (not shown) to engage second end 40 of tube 30.

In one or more embodiments, tube 30 may further include a gripping mechanism 55 disposed at the first end 38 of tube 30. Gripping mechanism 55 is not limited to a particular configuration.

For example, gripping mechanism 55 may be one or more handles to assist in manipulating plunger assembly 10 when installing plunger 12. Likewise, gripping mechanism may be a contoured surface. In any event, gripping mechanism 55 is disposed sufficiently adjacent the first end 38 of tube 30 so as not to interfere with insertion of tube 30 into a plunger pump fluid end (not shown) as described below.

Figure 2:
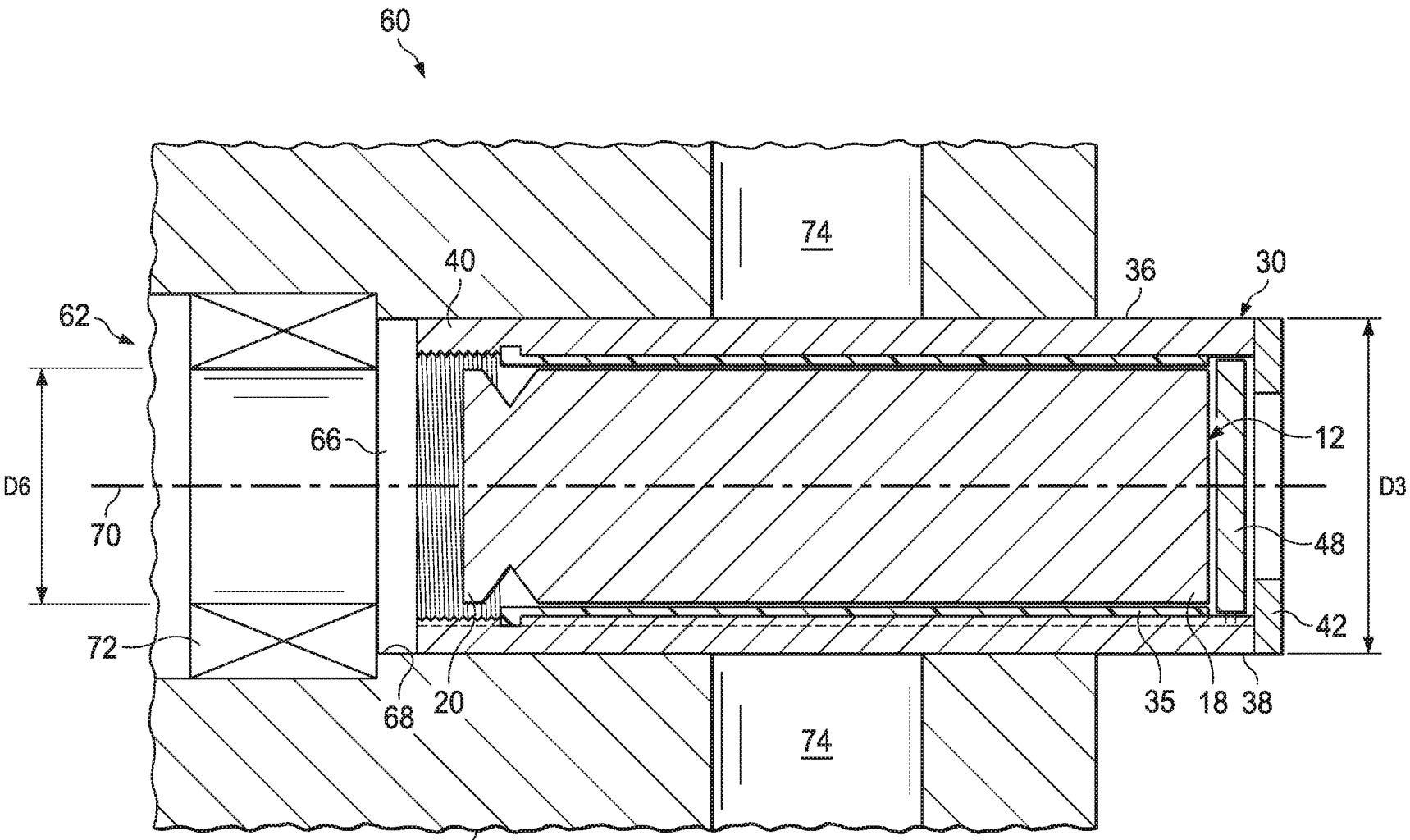
FIG. 2 is a cut-away elevation view of a portion of the fluid end of a plunger pump.

With reference to FIG. 2, a partial section of a plunger pump 60 is illustrated, and in particular, a section of a plunger pump fluid end 62. Fluid end 62 generally includes a manifold 64 in which one or more pump cylinder(s) 66 are formed. In particular, pump cylinder 66 is formed of a bore 68 extending along a cylinder axis 70. Disposed along a portion of bore 68 is plunger packing seal 72. Bore 68 is generally shown as intersecting or otherwise fluidically communicating with a flow path 74 formed in manifold 64. The foregoing description of a plunger pump 60 is provided for illustrative purposes only and persons of skill in the art will appreciate that plunger pumps 60 may have many different arrangements and the disclosure is not limited to a particular plunger pump configuration. In any event, it will be appreciated that the outer tube diameter D3 of tube 30 is selected to permit tube 30 to at least partially slide into the bore 68 of the plunger pump 60 for which a plunger 12 is to be installed. In the illustrated embodiment, it will be appreciated that the outer diameter D3 is greater than the inner diameter D6 of plunger packing seal 72. As such, tube 30 can be inserted into bore 68 until tube 30 abuts plunger packing seal 72.

Figure 3:
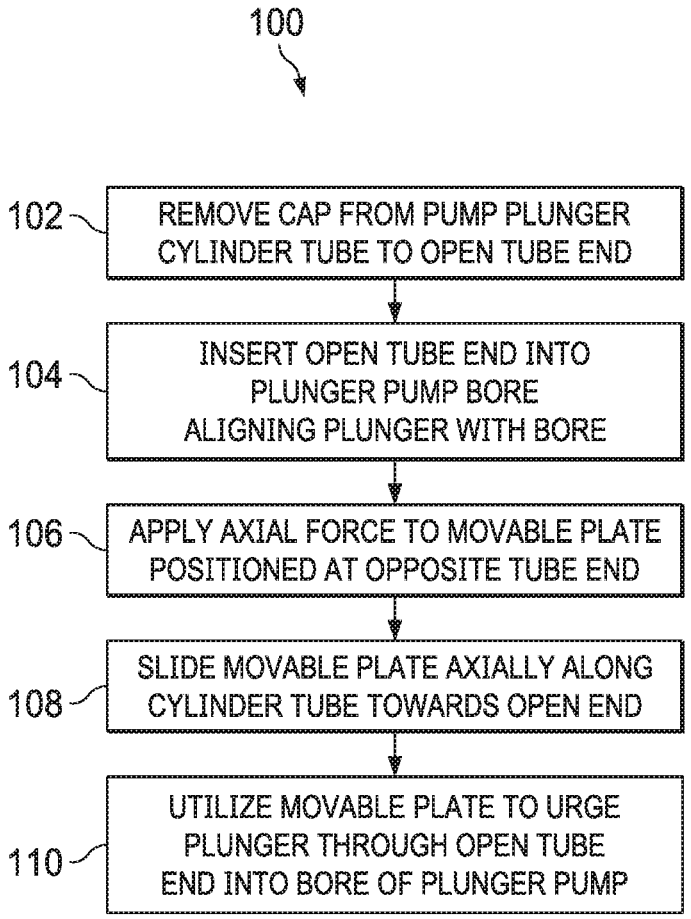
FIG. 3 is a flowchart of a method for installing a plunger into the fluid end of a plunger pump.

With ongoing reference to FIGS. 1 and 2, a method 100 for installing a plunger 12 in a plunger pump is illustrated by FIG. 3. In particular, a plunger 12 is secured within a elongated tube 30 for storage and/or transportation. Specifically, the plunger 12 is inserted into the open end of a elongated tube 30 until a first end 18 of the plunger 12 abuts a movable plate 48 within the elongated tube 30. In this regard, the elongated tube 30 is selected to have a length L2 greater than the length L1 of the plunger 12. Once the plunger 12 is inserted into tube 30, a removable cap 54 is attached adjacent an open end of tube 30 to secure the plunger 12 within tube 30. In one or more preferred embodiments, the removable cap 54 is secured in the open end 40 of the elongated tube 30 until the removable cap 54 abuts a second end 20 of the plunger 12, thereby securing the plunger 12 from axial movement within the elongated tube 30. In this regard, tube 30 and cap 54 may each be threaded so that cap 54 may be screwed into the open end of elongated tube 30. In other embodiments, cap 54 may be secured over the open end 40 of elongated tube 30. In any event, thereafter, the plunger 12 may be transported to the site of a plunger pump 60 for installation of the plunger 12 into the plunger pump 60. It will be appreciated that one benefit of the plunger assembly 10 as described herein is that the tube 30 protects the plunger 12 from damage during transportation.

In order to insert the plunger 12 into plunger pump 60, in step 102, the cap 54 is removed from the second end 40 of tube 30 so that the second end 40 of elongated tube 30 is open. In step 104, the second end 40 of tube 30 is inserted into the bore 68 of a plunger pump 60 so that tube 30 and plunger 12 are coaxially aligned along cylinder axis 70 with bore 68. Because of the weight of the plunger 12 within elongated tube 30, handles or other gripping mechanism 55 at the first end 38 of the elongated tube 30 may be utilized to manipulate tube 30 into engagement with bore 68. In one or more embodiments, elongated tube 30 is inserted into bore 68 until tube 30 abuts plunger packing seal 72 disposed within bore 68 so that the second end of plunger 12 is adjacent packing seal 72. At this point, where packing seal 72 is an annular sealing element, packing seal 72 and plunger 12 are generally coaxially aligned.

In step 106, an axial force is applied to movable plate 48. Because end wall 42 of tube 30 includes an aperture 44, the aperture 44 allows the axial force to be applied directly to movable plate 48.

In step 108, the axial force is utilized to slide the movable plate 48 axially along axis 16 of tube 30 from the first end 38 of elongated tube 30 towards the open second end 40 of tube 30. In one or more embodiments, tube 30 may include a liner 35 formed of a material to enhance sliding movement of movable plate (and plunger 12) within tube 30. Tube 30 may also include a slot 50 for receipt of a guide mechanism 52 extending from movable plate 48 to maintain alignment of movable plate 48 in tube 30 as movable plate 48 is translated axially therethrough.

In step 110, movable plate 48 urges the plunger 12 through the open end 40 of the tube 30 and into the bore 68 of the fluid end 64. In particular, plunger 12 is driven into mating contact with plunger packing seal 72. Thus, in addition to functioning to protect plunger 12 during transport and installation, tube 30, being aligned in bore 68, also functions to ensure that plunger 12 is accordingly aligned in cylinder 66 as plunger 12 is inserted within plunger packing seal 72. It will be appreciated that utilizing the forgoing plunger pump assembly 10, plunger 12 need never be directly handled during storage or transportation of plunger 12, nor during insertion of plunger 12 into plunger pump 60.

Thus, a plunger assembly for a plunger pump has been described. The plunger assembly may include an elongated, cylindrical plunger body having a first plunger end and a second plunger end; an elongated circular tube disposed around the cylindrical plunger body, the elongated tube having an inner tube surface, an inner tube diameter, a first tube end and a second tube end with an end wall at least partially enclosing the first tube end, the end wall having an aperture formed therein; an axially movable plate within the tube adjacent the end wall between the end wall and the first plunger end of the plunger body; and a removable cap mounted to the second end of the tube and adjacent the second plunger end of the plunger body. In other embodiments, the plunger assembly may include a cylindrical plunger body having a first plunger end and a second plunger end; an elongated circular tube disposed around the cylindrical plunger body, the elongated tube having an inner tube surface, an inner tube diameter, a first tube end and a second tube end with an end wall at least partially enclosing the first tube end, the end wall having an aperture formed therein; an axially movable plate within the tube adjacent the end wall between the end wall and the first plunger end of the plunger body, wherein the movable plate has an outer diameter that is smaller than the inner tube diameter; and a removable cap mounted to the second end of the tube and adjacent the second plunger end of the plunger body, wherein the removable cap fits at least partially within the second end of the tube and wherein the removable cap has an at least partially threaded perimeter and the inner tube surface adjacent the second end is threaded and disposed to engage the threads of the removable cap.

For any of the foregoing embodiments, the assembly may include any one of the following elements, alone or in combination with each other:

The movable plate has an outer diameter that is smaller than the inner tube diameter.

The removable cap fits within the second end of the tube.

The removable cap fits over the second end of the tube.

The removable cap fits at least partially within the second end of the tube.

The removable cap has a threaded perimeter and the tube has an inner tube wall adjacent the second end that is threaded and disposed to engage the threads of the removable cap.

A liner disposed along at least a portion of the inner tube surface.

The liner is plastic.

The liner is rubber.

The plunger body comprises an attachment mechanism at the second plunger end.

The attachment mechanism is a contour in an outer surface of the plunger body.

The cylindrical tube further comprises an axially extending slot along at least a portion of inner tube surface, and the movable plate further comprises a radially extending guide mechanism that engages the slot.

The cylindrical tube further comprises first and second linear slots, each slot extending axially along at least a portion of inner tube surface, the slots being spaced apart from one another about the inner tube diameter, and wherein the movable plate further comprises first and second radially extending guide mechanisms, wherein each guide mechanism engages a slot.

The cylindrical tube further comprises first and second linear slots, each slot extending axially along at least a portion of inner tube surface, the slots being spaced apart from one another about the inner tube diameter, and wherein the movable plate further comprises first and second radially extending guide mechanisms, wherein each guide mechanism engages a slot.

The cylindrical plunger body has a first length and the circular tube has a second length, wherein the second length is greater than the first length.

Relatedly, a method for installing a plunger in a plunger pump has been described. Embodiments of the plunger installation method may include removing a cap from the end of a cylindrical tube containing a plunger body to open an end of the cylindrical tube; inserting the open end of the cylindrical tube into the bore of the fluid end of a plunger pump so that the bore and the cylindrical tube are substantially coaxial and an end of the plunger body extends within the bore; applying an axial force to a movable plate carried within the tube adjacent the other end of the cylindrical tube; sliding the movable plate axially along the tube towards the open end; and utilizing the movable plate to urge the plunger body through the open end of the tube and into the bore of the fluid end.

For the foregoing embodiments, the method may include any one of the following steps, alone or in combination with each other:

Removing the cylindrical tube from the bore, and thereafter, operating the pump.

Securing a plunger body within a cylindrical tube.

Securing comprises inserting a plunger body in the cylindrical tube until a first end of the plunger body abuts a movable plate within the cylindrical tube and attaching a removable cap to the cylindrical tube adjacent a second end of the plunger body.

Attaching a removable cap comprises screwing the removable cap into an open end of the cylindrical tube until the removable cap abuts the second end of the plunger body and the first end of the plunger body abuts the movable plate.

Attaching a removable cap comprises urging the removable cap into an open end of the cylindrical tube until the removable cap abuts the second end of the plunger body and the first end of the plunger body abuts the movable plate, and securing the removable cap.

Inserting the cylindrical tube into the bore comprises positioning the cylindrical tube in the bore so that the open end of the cylindrical tube is adjacent plunger packing disposed along the bore.

Abutting the open end of the cylindrical tube against the plunger packing and urging the plunger body into sealing engagement with the plunger packing.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

The invention claimed is:

1. A plunger assembly for a hydraulic fracturing plunger pump, the plunger assembly comprising:

an elongated, cylindrical plunger body having a first plunger end and a second plunger end;

an elongated cylindrical tube disposed around the cylindrical plunger body, the elongated tube having an inner tube surface, an inner tube diameter, a first tube end and a second tube end with an end wall at least partially enclosing the first tube end, the end wall having an aperture formed therein;

an axially movable plate within the tube adjacent the end wall between the end wall and the first plunger end of the plunger body; and a removable cap mounted to the second end of the tube and adjacent the second plunger end of the plunger body.

2. The plunger assembly of claim 1, wherein the movable plate has an outer diameter that is smaller than the inner tube diameter.

3. The plunger assembly of claim 1, wherein the removable cap fits within the second end of the tube.

4. The plunger assembly of claim 1, wherein the removable cap fits over the second end of the tube.

5. The plunger assembly of claim 1, wherein the removable cap fits at least partially within the second end of the tube.

6. The plunger assembly of claim 1, wherein the removable cap has threads provided on a threaded perimeter and the tube has an inner tube wall adjacent the second tube end that is threaded and disposed to engage the threads of the removable cap.

7. The plunger assembly of claim 1, wherein the plunger body comprises an attachment mechanism at the second plunger end.

8. The plunger assembly of claim 7, wherein the attachment mechanism is a contour in an outer surface of the plunger body.

9. The plunger assembly of claim 1, wherein the cylindrical tube further comprises an axially extending slot along at least a portion of the inner tube surface, and the movable plate further comprises a radially extending guide mechanism that engages the slot.

10. The plunger assembly of claim 1, wherein the cylindrical tube further comprises first and second linear slots, each slot extending axially along at least a portion of the inner tube surface, the slots being spaced apart from one another about the inner tube diameter, and wherein the movable plate further comprises first and second radially extending guide mechanisms, wherein each guide mechanism engages one of the slots.

11. A plunger assembly for a hydraulic fracturing plunger pump, the plunger assembly comprising:

a cylindrical plunger body having a first plunger end and a second plunger end;

a cylindrical tube disposed around the cylindrical plunger body, the tube having an inner tube surface, an inner tube diameter, a first tube end and a second tube end with an end wall at least partially enclosing the first tube end, the end wall having an aperture formed therein;

an axially movable plate within the tube adjacent the end wall between the end wall and the first plunger end of the plunger body, wherein the movable plate has an outer diameter that is smaller than the inner tube diameter; and a removable cap mounted to the second end of the tube and adjacent the second plunger end of the plunger body, wherein the removable cap fits at least partially within the second tube end and wherein the removable cap has threads provided on an at least partially threaded perimeter thereof and the inner tube surface adjacent the second tube end is threaded and disposed to engage the threads of the removable cap.

12. The plunger assembly of claim 11, wherein the cylindrical tube further comprises first and second linear slots, each slot extending axially along at least a portion of the inner tube surface, the slots being spaced apart from one another about the inner tube diameter, and wherein the movable plate further comprises first and second radially extending guide mechanisms, wherein each guide mechanism engages one of the slots.

13. A method for installing a plunger in a plunger pump, the method comprising:

removing a cap from an end of a cylindrical tube containing a plunger body to open an end of the cylindrical tube;

inserting the open end of the cylindrical tube into a bore of a fluid end of a plunger pump so that the bore and the cylindrical tube are substantially coaxial and an end of the plunger body extends within the bore;

applying an axial force to a movable plate carried within the adjacent the other end of the cylindrical tube;

sliding the movable plate axially along the tube towards the open end; and utilizing the movable plate to urge the plunger body through the open end of the tube and into the bore of the fluid end.

14. The method of claim 13, further comprising removing the cylindrical tube from the bore, and thereafter, operating the pump.

15. The method of claim 13, further comprising securing the plunger body within the cylindrical tube.

16. The method of claim 15, wherein securing comprises inserting the plunger body in the cylindrical tube until a first end of the plunger body abuts the movable plate within the cylindrical tube and attaching the removable cap to the cylindrical tube adjacent a second end of the plunger body.

17. The method of claim 16, wherein attaching the removable cap comprises screwing the removable cap into the open end of the cylindrical tube until the removable cap abuts the second end of the plunger body and the first end of the plunger body abuts the movable plate.

18. The method of claim 16, wherein attaching the removable cap comprises urging the removable cap into the open end of the cylindrical tube until the removable cap abuts the second end of the plunger body and the first end of the plunger body abuts the movable plate, and securing the removable cap.

19. The method of claim 13, wherein inserting the cylindrical tube into the bore comprises positioning the cylindrical tube in the bore so that the open end of the cylindrical tube is adjacent plunger packing disposed along the bore.

20. The method of claim 19, further comprising abutting the open end of the cylindrical tube against the plunger packing and urging the plunger body into sealing engagement with the plunger packing.

* * * * *